United States Patent [19]

Carpenter, Jr. et al.

[11] Patent Number: 4,591,779

[45] Date of Patent: May 27, 1986

[54] REGULATED A.C. POWER SUPPLY

[75] Inventors: Roy B. Carpenter, Jr., Whittier; Mark Drabkin, La Mirada, both of Calif.

[73] Assignee: LEA Dynatech Inc., Santa Fe Springs, Calif.

[21] Appl. No.: 642,631

[22] Filed: Aug. 20, 1984

[51] Int. Cl.[4] ..... G05F 5/04

[52] U.S. Cl. ..... 323/301; 323/255; 323/340

[58] Field of Search ..... 323/255, 257, 301, 340, 323/343, 356; 361/35, 111

[56] References Cited

U.S. PATENT DOCUMENTS

| | | | |
|---|---|---|---|
| 3,978,395 | 8/1976 | Legnaioli | 323/255 |
| 4,016,477 | 4/1977 | Ghiringhelli | 363/64 |
| 4,481,564 | 11/1984 | Balaban | 363/21 |

FOREIGN PATENT DOCUMENTS

| | | | |
|---|---|---|---|
| 0033056 | 3/1977 | Japan | 323/255 |
| 1558568 | 1/1980 | United Kingdom | 323/301 |
| 964594 | 10/1982 | U.S.S.R. | 323/255 |

*Primary Examiner*—Peter S. Wong
*Assistant Examiner*—Judson H. Jones

[57] ABSTRACT

A voltage regulator capable of maintaining the output voltage of a unit, such as a power supply, incorporating said voltage regulator within, for example, ±5 percent of say, 115 volts, a.c., without any interruptions in the power supply output voltage and without any distortion of the a.c. sine wave.

This is accomplished through the monitoring of varying secondary transformer output voltages according to the primary input voltage variations by means of a comparator processing a signal to power relays which switch to specific secondary transformer taps without causing interruptions of the output power and without distortions of the a.c. sine wave, respectively. Various additional devices are provided to enhance the described regulated a.c. power supply performance.

2 Claims, 3 Drawing Figures

REGULATED A.C. POWER SUPPLY

BACKGROUND

Several voltage regulator concepts and constructions of them for power supplies are known in the art, utilizing, in one fashion or another, transformers of various types such as saturable reactors, ferroresonant transformers, motor-driven or manually adjustable transformers (also called variable transformers and variacs) and electronically switched transformers of either the zero voltage crossover or the zero current switch variety.

PRIOR ART

Voltage regulation, including that for power supplies, by tap switching of primary and/or secondary windings is well known. Tap switching by means of relays and contactors is also known. Further, individual triacs or SCRs have been employed for tap switching.

However, none of the foregoing is used in these teachings. Instead, an individual switch is used for each tap changing. This is believed to be the primary novel feature without precedent known to the applicants.

The aforementioned known voltage regulators provide wholly or partly unsatisfactory performances because of one or more of the following reasons:

Typical disadvantages of existing methods are oversaturation without appreciable voltage regulation, wave form distortion, limited regulation ranges, low RFI filtering, slow reaction time, emission of switching transients, no lightning protection, high cost and questionable dependability. However, one of the major shortcomings of those prior-art regulators are the objectionable ill-effects on the a.c. wave continuity during the change of operational transformer windings, be it from one turn to others, or from one tap to another tap of the winding.

SUMMARY OF INVENTION

The subject of this invention is a voltage regulator concept as used, in this example, for power supplies and capable of maintaining the output voltage within, say, ±5 percent of a line voltage of, for example, 115 volts, without any output power interruptions during any regulation period and without distortion of the a.c. sine wave of the system.

In contrast to conventional voltage regulators, the regulation of the output voltage is arranged at the output side of the transformer, or more specifically, at taps on the secondary transformer winding and is then monitored through voltage sensors, processed and gated so as to produce an input signal to at least one of a group of power relays, each of which connects that transformer tap automatically to the output terminal of the phase, which will apply a voltage within the specified margin of voltage regulation.

Instead of the customary opening of one said relay to be followed by a closing of the same, or another relay, depending on the regulation command, the tap connection change occurs in the subject concept at the same time for two taps, whereby one relay is closing its load contacts and the other relay is opening its load contacts within an adjustable interval of, say, less than one millisecond, thereby precluding an interruption of, especially, the a.c. sine wave continuity.

Provisions are made to absorb the transitory short circuit current flow between the two temporarily closed taps.

Preferred applications for voltage regulators having the herein described characteristics are power centers for the operation of computers and data line equipment, to mention but a few.

It should further be noted that both a surge eliminator and a filter unit can be provided at the input side of the subject voltage regulator and a transient eliminator at its load side, resulting in a desirable power source configuration having capabilities to regulate, protect and filter a system. The protection does not extend to that against complete loss of power.

The two main problems commonly associated with relay switching are overcome as follows:

(a) The slow-switching predicament and the potential loss of any portion of the system sine wave was eliminated by using a close-before-open contact arrangement and sequence;

(b) the potential switching transient and the short circuit current resulting from two transformer winding taps closed for an instant (typically for less than one millisecond) was impeded and filtered out by the filter components as described in this disclosure.

Additional applications for and advantages of the subject improvement will become apparent from the following description and the accompanying drawings.

In the drawing forming a part of the application:

FIG. 1 is a schematic diagram of a typical voltage regulator for the power supply operation across a single-phase of an a.c. system, FIG. 2 is a combination schematic and flow diagram of the relay control applied in this improvement and FIG. 3 is a schematic of a voltage regulator for a subject power supply showing a single-phase arrangement example.

DETAILED DESCRIPTION

Figure 1:
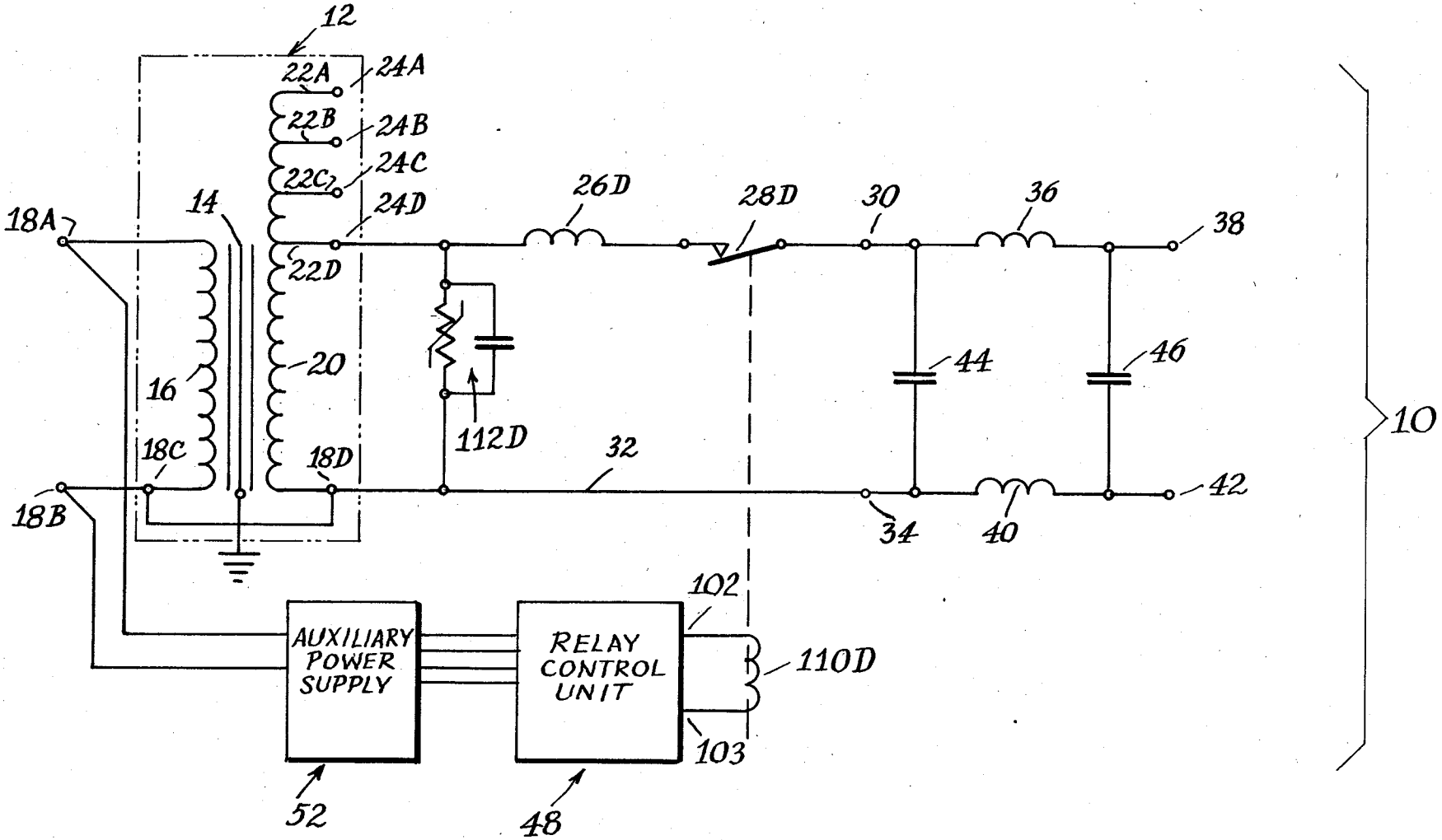

Referring now to the drawing wherein like legends and reference numerals, respectively, designate like or corresponding parts and, more particularly, to FIG. 1, the concept of the subject regulated a.c. power supply 10 is presented schematically herein. A transformer 12 having a grounded core 14, a primary winding 16 with its terminals 18A and 18B and a secondary winding 20, the latter being equipped with, for example, four taps 22A, 22B, 22C and 22D arranged at a beginning of said secondary winding 20 and having terminals 24A, 24B, 24C and 24D, is connected across an a.c. line and neutral with its primary winding terminals 18A and 18B, respectively. The neutral is continued from terminal 18C to 18D.

A choke 26D and a relay load contact 28D are connected in series from said tap terminal 24D to the live junction 30, whereas the wire 32 is carried solidly to the junction 34 in the grounded neutral.

An assembly 112D consisting of a capacitor and a nonlinear resistor in parallel is connected across each terminal 24A, 24B, 24C and 24D to the secondary neutral 32, as indicated for only terminal 24D to the neutral in FIG. 1.

A filter network is connected to the terminals 30 and 34, respectively, as follows: A choke 36 is connected in series between the live junction 30 and the live output power terminal 38; a choke 40 is connected in series between the neutral junction 34 and the neutral output power terminal 42; a capacitor 44 is connected across the terminals 30 and 34, whereas another capacitor 46 is connected across the terminals 38 and 42. It should be noted that the presented filter network is but one of the typical and possible filter configurations and that other arrangements of the component filter parts may be required for the matching of specific operational characteristics without affecting the substance of this invention.

The control of the relay load contacts 28D for single-phase operation and contacts 28A through 28C for three-phase operation is negotiated by a relay control unit 48, which is supplied with regulated voltages from an auxiliary power supply 52, the latter receiving its input power from the, for example, 115 V a.c. line by being connected across the terminals 18A and 18B.

It should be noted that all foregoing descriptions and the schematic in FIG. 1 depict the principle of this invention for but one a.c. phase, as will, unless otherwise stated, all subsequent presentations and illustrations. If more than one a.c. phase is to be provided with the subject voltage regulation, one such piece of equipment will be required for each phase in a self-explanatory manner.

Figure 2:
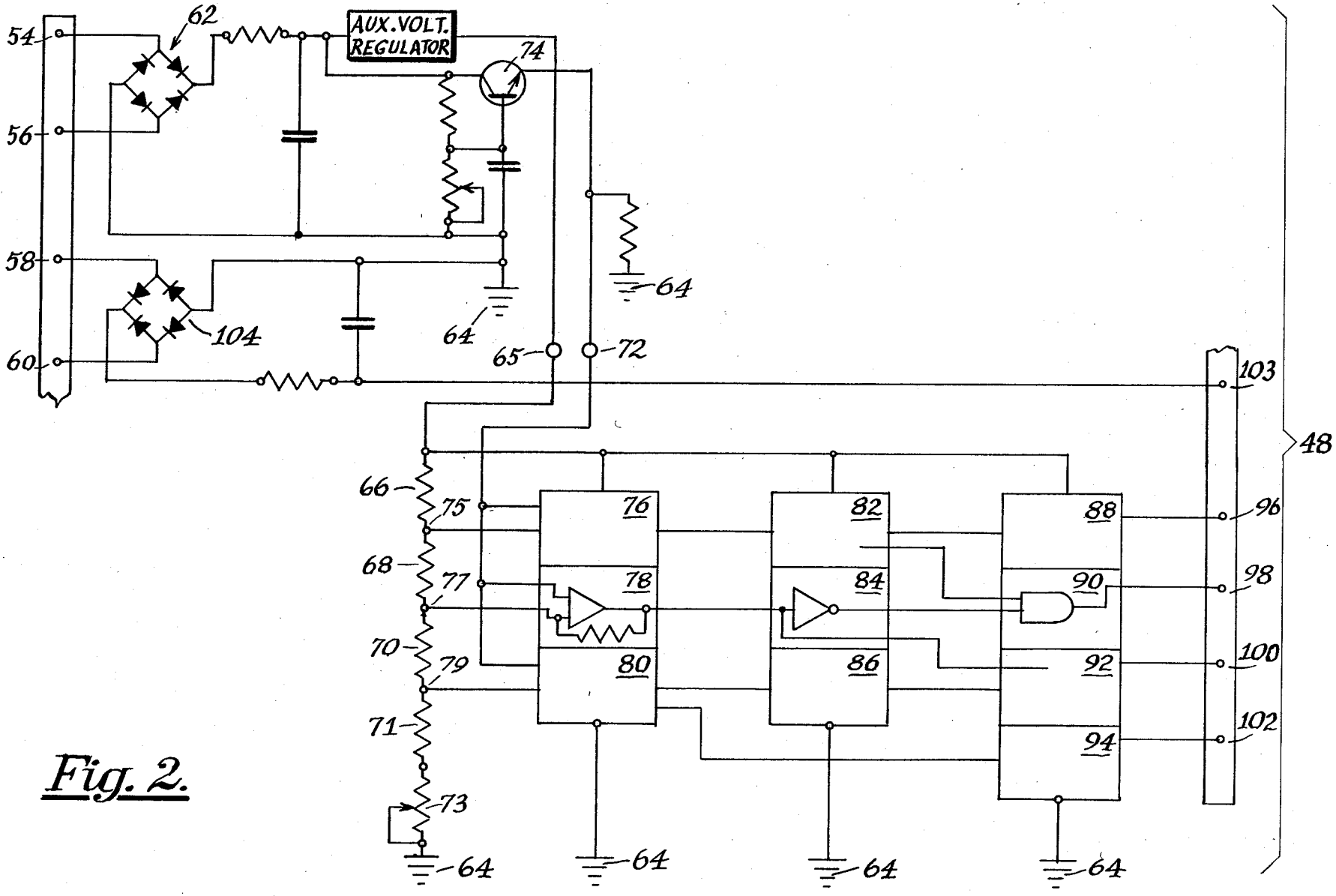
Figure 3:
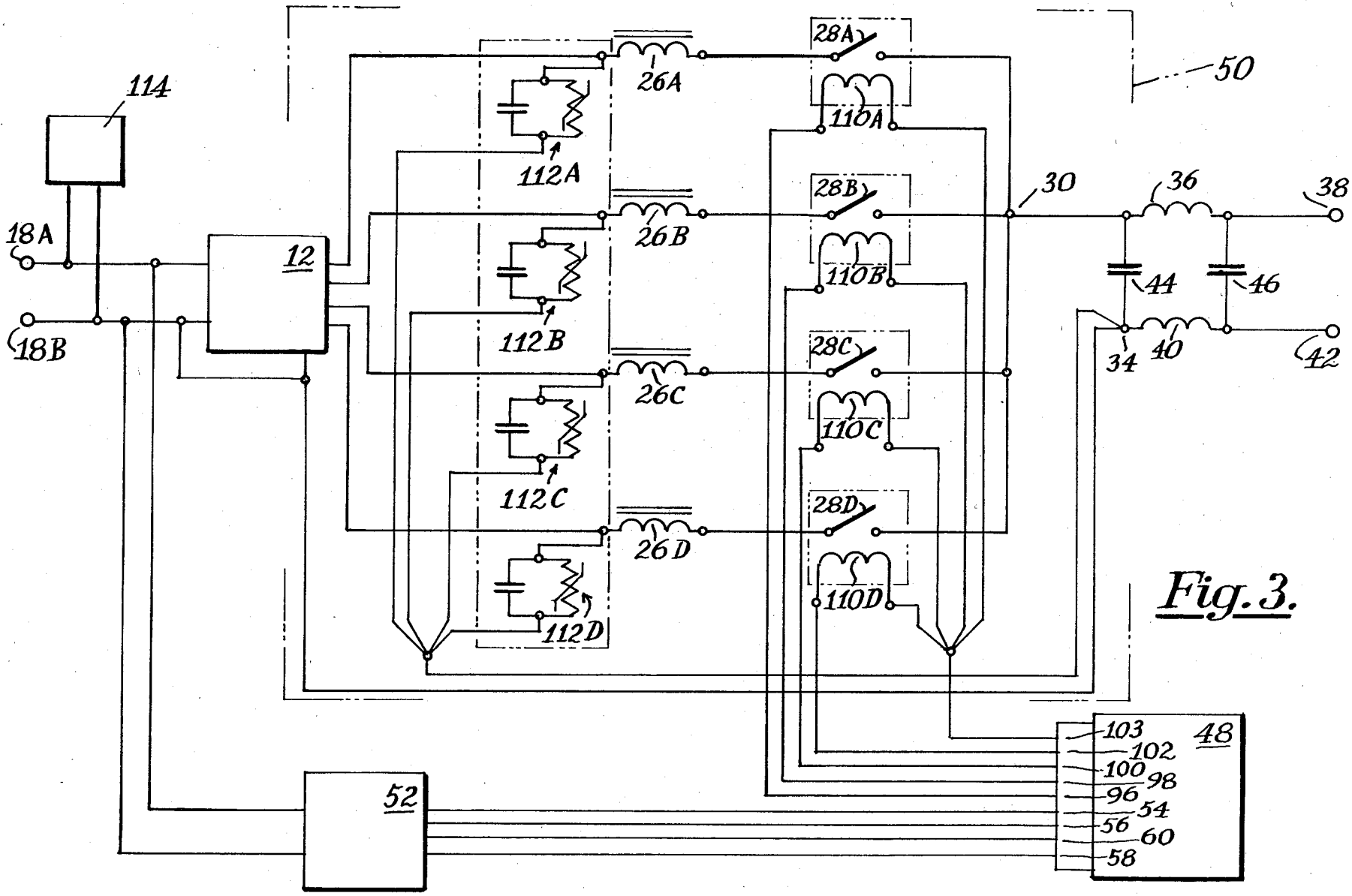

The voltage regulator was, for example, elected to consist of two separate units, namely, the relay control unit 48 as shown in the circuit diagram in FIG. 2 and the voltage regulator unit 50, presented in the circuit diagram in FIG. 3. Depending on choices and prevailing conditions, both these units 48 and 50 may be within the same physical structure.

The auxiliary power supply 52, indicated in the schematic of FIG. 1 and FIG. 3, is of a rather conventional type and, therefore, not illustrated in detail, except that it is required to deliver two output voltages, one of, for example, 6.3 V rms, the other one of, say, 26.8 V rms.

Referring to FIG. 2, the 6.3 V rms voltage is applied across the terminals 54 and 56, whereas the 26.8 V rms voltage is applied across the terminals 58 and 60.

The 6.3 V rms a.c. is rectified through a full-wave bridge rectifier 62 and its output is connected, disregarding various conventional component parts, to ground 64 and to a voltage divider array, respectively, consisting, in this example, of the resistors 66, 68, 70, 71 and the adjustable resistor 73, connected in series to ground 64. A reference bus 72, originating at the emitter of the transistor 74 serves to pick up a reference voltage for, in this case, the comparators 76, 78 and 80, each said comparator input being connected across said reference bus 72 and the unions 75, 77 and 79 of the resistor array, respectively. Disregarding, again, various internal component parts, the intelligence outputs of said comparators 76, 78 and 80, respectively, are fed into hex-inverters, or equivalent, 82, 84 and 86, respectively and thence into AND-gates 88, 90, 92 and 94, respectively, to then connected, together with other internal component parts to the output terminals 96, 98, 100 and 102 of said relay control unit 48. It should be noted that the AND-gates 88, 90, 92 and 94 also function as "mixers" in a manner known in this art. The salient internal component parts typical for each respective aforementioned sub-unit are shown, symbolically, in the frames 78, 84 and 90, chosen at random.

The 26.8 V rms a.c. voltage from the respective auxiliary power supply output, in turn, is rectified through, in this case, the full-wave bridge rectifier 104 and its output is connected to the terminal 103 and d.c. ground 64, respectively.

The circuit diagram of the voltage regulator unit 50 is presented in FIG. 3. For ready reference, the auxiliary power supply 52 and the relay control unit 48 are shown schematically.

In each of the four relay contact branches shown, a choke 26A, 26B, 26C and 26D, respectively, is connected in series with a normally-open relay contact 28A, 28B, 28C and 28D, respectively, between a transformer tap terminal 24A, 24B, 24C and 24D, respectively, and the junction 30. The four coils 110A, 110B, 110C and 110D, respectively, are wired as follows: Relay coil 110A between terminals 96 and 103; relay coil 110B between terminals 98 and 103; relay coil 110C between terminals 100 and 103 and relay coil 110D between terminals 102 and 103. A capacitor and MOV assembly 112A, 112B, 112C and 112D, respectively, is connected across each transformer tap terminal 24A, 24B, 24C and 24D, respectively, and the neutral junction 34. The typical L-C filter network, as first shown in FIG. 1, appears also in FIG. 3, connected between the junctions 30 and 34 and the voltage regulator output terminals 38 and 42, respectively.

From the foregoing description it becomes apparent that the tap-changing voltage regulator is of straightforward design and that, by employing previously proven concepts and methods also two problems associated with relay switching practices were averted, namely, (a) the slow switching process and potential loss of the a.c. sine wave by using the close-before-open concept and (b) the potential switching transient and short circuit current resulting from any two transformer secondary winding taps being closed for an instant by the components of the filter network at the voltage regulator output terminals.

A surge protector 114 is readily connected across the input terminals 18A and 18B and provides the protection against transients coming along the a.c. power input line.

More specifically, the voltage regulator operation is as follows:

Normally, the input voltage across the terminals 18A and 18B assumed to be 115 volts and so will be the output voltage across the terminals 38 and 42 if, for example, the connection from the secondary wire tap 24 is established through the closed relay contact 28C.

When the input voltage drops, for example, for more than 5 volts, it causes to turn off the relay coil 110C and to turn on, say, the relay coil 110B so that the tap 24C will become opened and the tap 24B connected to the output terminal 38 through the now closed load contact 28B of relay coil 110B. The changed transformer ratio allows to maintain the output voltage within the given limits of ±5 volts variation with respect to the nominal 115 volt output voltage.

It is understood that the herein shown and described embodiments of the subject invention are but illustrative and that variations, modifications and alterations are feasible within the spirit of these teachings.

I claim:

1. A regulated a.c. power supply for delivering power at a regulated a.c. output through switching of secondary transformer winding taps in a manner so as to impede switching transients and momentary short circuit currents occurring during the switching process without the loss of any portion of the a.c. sine wave and without incident ill-effects of switching having an auxiliary power supply connected with an unregulated a.c. supply phase and providing regulated power of at least one discrete voltage and polarity, means for filtering noise, RFI and related undesirable and prohibitive equipment manifestations ahead of the output terminals of the subject voltage regulator and means for the protection against hazards incoming with the a.c. power line transients, comprising in combination:

a transformer having a primary winding connected with the a.c. supply line and a secondary winding equipped with at least two taps, at least one relay having a coil and at least one single-pole, single-throw, normally-open load contact, a said relay load contact connected across each of said at least two adjacent secondary transformer winding taps, a relay control unit receiving regulated power of at least one discrete voltage and polarity, said relay control unit having means for sensing and monitoring the a.c. supply line voltage for the corresponding energizing of a said relay coil and actuating a said relay load contact individually and in a sequence with another said relay load contact, selectively.

2. A regulated a.c. power supply including a voltage regulator for regulating the a.c. output system voltage without switching all-effects and the loss of any portion of the a.c. system sine wave in a manner so as to impede switching transients and momentary short circuit currents occurring during the switching process, comprising in combination:

a transformer, said transformer having a grounded core, a primary winding having two terminals for its connection across at least one line and the common neutral of each phase of an a.c. system and a secondary winding having a terminal for the connection with a common neutral and ground, respectively, of each phase of an a.c. system and at least two taps, each having a terminal, at least two chokes, each having a first and a second terminal, one of each said choke connected with its first said terminal to one of said at least two tap terminals, a relay having at least one single-pole, single-throw, normally-open load contact and one coil for each said relay load contact actuation, each said single-pole, single-throw, normally-open relay load contact having a first and a second terminal, one of each said first terminal connected, in series, with one of said second terminal of one said choke, a relay control unit having two pairs of auxiliary d.c. power supplies and at least five output terminals, said relay control unit having means for the sensing, the monitoring and the processing of the supply line voltage fluctuations and means for the energizing and de-energizing, selectively, of one said relay coil and for the de-energizing and energizing, selectively, of another said relay coil in a predetermined and controlled sequence so as to cause the closing of one said relay load contact, its maintaining in the closed position and to cause the closing of another relay load contact before a formerly closed relay load contact is caused to become opened, a first junction connected with all said second terminals of said single-pole, single-throw, normally-open relay load contacts, a second junction connected with said transformer neutral terminal, an auxiliary power supply having two input terminals for the connection with a phase of an unregulated a.c. system supply and a first and a second pair of output terminals, each said output terminal pair delivering regulated power of both a specific voltage and polarity orientation to the corresponding input terminals of said relay control unit, a filter network including one output line choke per phase, one common neutral line choke and a capacitor connected across the line and neutral of each phase ahead of said output line choke and a capacitor connected across the line and neutral of each phase past said output line choke.

* * * * *